US010702735B2

(12) United States Patent
Nelson et al.

(10) Patent No.: US 10,702,735 B2
(45) Date of Patent: Jul. 7, 2020

(54) ASSISTIVE REHABILITATION ELLIPTICAL SYSTEM

(71) Applicants: NUTech Ventures, Lincoln, NE (US); MADONNA REHABILITATION HOSPITAL, Lincoln, NE (US)

(72) Inventors: Carl A. Nelson, Lincoln, NE (US); Cale J. Stolle, Lincoln, NE (US); Judith M. Burnfield, Lincoln, NE (US); Thad W. Buster, Gretna, NE (US); Bernadette J. McCrory, Seward, NE (US)

(73) Assignees: NUtech Ventures, Lincoln, NE (US); Madonna Rehabilitation Hospital, Lincoln, NE (US)

( * ) Notice: Subject to any disclaimer, the term of this patent is extended or adjusted under 35 U.S.C. 154(b) by 63 days.

(21) Appl. No.: 15/560,541

(22) PCT Filed: Mar. 23, 2016

(86) PCT No.: PCT/US2016/023788
§ 371 (c)(1),
(2) Date: Sep. 22, 2017

(87) PCT Pub. No.: WO2016/154318
PCT Pub. Date: Sep. 29, 2016

(65) Prior Publication Data

US 2018/0111017 A1 Apr. 26, 2018

Related U.S. Application Data

(60) Provisional application No. 62/136,957, filed on Mar. 23, 2015.

(51) Int. Cl.
*A63B 22/00* (2006.01)
*A63B 22/06* (2006.01)
(Continued)

(52) U.S. Cl.
CPC ..... *A63B 22/0015* (2013.01); *A63B 21/0059* (2015.10); *A63B 21/00069* (2013.01);
(Continued)

(58) Field of Classification Search
CPC ..... A63B 22/0015; A63B 22/0664; A63B 22/0605; A63B 2022/0028–0043; A63B 22/06–0694
See application file for complete search history.

(56) References Cited

U.S. PATENT DOCUMENTS

| | | | |
|---|---|---|---|
| 8,007,405 | B2 | 8/2011 | Burnfield et al. |
| 8,177,688 | B2 | 5/2012 | Burnfield et al. |

(Continued)

FOREIGN PATENT DOCUMENTS

| | | |
|---|---|---|
| EP | 1 518 589 A2 | 8/2004 |
| WO | WO 98/48902 | 11/1998 |
| WO | 2008114291 | 9/2008 |

OTHER PUBLICATIONS

Notification of Transmittal of the International Search Report and the Written Opinion of the International Searching Authority—dated Jun. 29, 2016.

*Primary Examiner* — Nyca T Nguyen
(74) *Attorney, Agent, or Firm* — Jenkins, Wilson, Taylor & Hunt, P.A.

(57) ABSTRACT

An elliptical system is disclosed having a crank assembly configured to be adjusted in length to accommodate users having varying gaits. In some embodiments, the crank assembly includes a crank and an axle connection bracket that is slidably adjustable with respect to the crank. For example, the crank assembly can include a crank link having a longitudinal body, where the longitudinal body is connected to the crank at one end and includes a longitudinal slot slidably coupled with the axle connection bracket. The axle connection bracket is configured to slide through a
(Continued)

plurality of positions along the longitudinal body. In some embodiments, the crank assembly further includes a screw for adjusting the axle connection bracket with respect to the crank, where the screw can cause the axle connection bracket to slide through one or more positions of the plurality of positions when the screw is turned.

5 Claims, 6 Drawing Sheets

(51) Int. Cl.

| | |
|---|---|
| ***A63B 21/22*** | (2006.01) |
| ***A63B 21/00*** | (2006.01) |
| ***A63B 24/00*** | (2006.01) |
| ***A63B 21/005*** | (2006.01) |
| ***A63B 21/008*** | (2006.01) |

(52) U.S. Cl.

CPC .... *A63B 21/0085* (2013.01); *A63B 21/00181* (2013.01); *A63B 21/225* (2013.01); *A63B 22/001* (2013.01); *A63B 22/0664* (2013.01); *A63B 24/0062* (2013.01); *A63B 24/0087* (2013.01); *A63B 2022/067* (2013.01); *A63B 2024/009* (2013.01); *A63B 2208/12* (2013.01); *A63B 2225/09* (2013.01)

(56) References Cited

U.S. PATENT DOCUMENTS

| | | | | |
|---|---|---|---|---|
| 9,550,089 | B2 * | 1/2017 | Tseng | A63B 21/225 |
| 2002/0198084 | A1 * | 12/2002 | Stearns | A63B 21/068 482/57 |
| 2006/0003871 | A1 * | 1/2006 | Houghton | A63B 22/001 482/57 |
| 2006/0142122 | A1 * | 6/2006 | Kettler | A63B 22/001 482/52 |
| 2006/0250753 | A1 * | 11/2006 | Lui | A63B 22/0015 361/600 |
| 2008/0242516 | A1 | 10/2008 | Lu et al. | |
| 2009/0264257 | A1 | 10/2009 | Anderson et al. | |
| 2010/0251850 | A1 | 10/2010 | Wang | |
| 2016/0001122 | A1 * | 1/2016 | Dalebout | A63B 22/0015 482/52 |

* cited by examiner

ASSISTIVE REHABILITATION ELLIPTICAL SYSTEM

CROSS-REFERENCE TO RELATED APPLICATIONS

The present application claims the benefit under 35 U.S.C. § 119(e) of U.S. Provisional Patent Application No. 62/136,957, filed Mar. 23, 2015, and titled "ASSISTIVE REHABILITATION ELLIPTICAL SYSTEM." U.S. Provisional Patent Application No. 62/136,957 is incorporated herein by reference in its entirety.

FEDERALLY SPONSORED RESEARCH OR DEVELOPMENT

This invention was made with United States Government support under Grant No. 90IF0060 awarded by the National Institute on Disability, Independent Living, and Rehabilitation Research/Administration for Community Living (formerly referenced as Grant No. H133G130274 awarded by the Department of Education/National Institute on Disability and Rehabilitation Research). The Unites States Government has certain rights in this invention.

BACKGROUND

The capacity to navigate through the world creates opportunities for children to explore, learn, and maintain fitness. Following debilitating accidents, injuries, surgeries, or illnesses, some children experience difficulty walking. Gait therapy, involving intensive and repetitive stepping, is often recommended to enhance the child's walking ability. Effective gait therapy is also critical to children who have difficulty walking due to developmental, neurologic or orthopedic conditions.

Some methods of pediatric gait retraining include manual overground gait training with assistance from a clinician, partial body-weight support treadmill training, and robotic therapy. The manual assistance that clinicians provide during overground gait therapy and partial body-weight support treadmill training can be very physically challenging for a clinician. Robotic devices tend to be very expensive, thus prohibiting widespread use. Current gait training technologies can be cost prohibitive and often do not address the needs of children of varying sizes. In addition, clinicians often need to provide significant physical assistance to children with profound weakness.

SUMMARY

An assistive rehabilitation elliptical system is described herein that can overcome barriers to gait training. The elliptical system can include a crank assembly configured to be adjusted in length to accommodate users having varying gaits. In some embodiments, the crank assembly includes a crank and an axle connection bracket that is slidably adjustable with respect to the crank. For example, the crank assembly can include a crank link having a longitudinal body, where the longitudinal body is connected to the crank at one end and includes a longitudinal slot slidably coupled with the axle connection bracket. The axle connection bracket is configured to slide through a plurality of positions along the longitudinal body. In some embodiments, the crank assembly further includes a screw for adjusting the axle connection bracket with respect to the crank, where the screw can cause the axle connection bracket to slide through one or more positions of the plurality of positions when the screw is turned.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The Detailed Description is described with reference to the accompanying figures. The use of the same reference numbers in different instances in the description and the figures may indicate similar or identical items.

DETAILED DESCRIPTION

Overview

In some embodiments, an assistive rehabilitation elliptical system is described that can overcome barriers to gait training. The assistive rehabilitation elliptical system can be an affordable tool that can be used to promote gait-like movement patterns in patients with physical disabilities and chronic conditions. For example, the assistive rehabilitation elliptical system does not require intensive control over the flexion and extension of individual joints in the lower extremities. Rather, the assistive rehabilitation elliptical system guides a patient's foot through an "elliptical" path, loosely simulating the trajectory of the foot during overground walking.

An assistive rehabilitation elliptical system can include an adjustment mechanism, such as screw-and-slider joint, gear and rack, worm/gear or worm/rack, hydraulic or pneumatic coupling, or any other sliding joint that facilitates linear movement of an axle connection bracket of the crank assembly with respect to the crank (effectively changing the crank length). While various examples are provided, the actuation can be achieved in any manner to adjust the effective length of the crank in the elliptical machine, reducing the step length and stride height simultaneously. The trajectories of the foot pedal can be normalized against stride length, and can show nearly identical trajectories between pediatric strides and adult strides. Simulation results and human usability studies have verified the design.

As described herein, the assistive rehabilitation elliptical system may include a motor to accommodate differing levels of lower extremity strength, allowing weak muscular groups to exercise without requiring excessive exertion. Adjustments to the training speed and level of external body-weight support can allow customization of the muscle demands experienced by the legs. Ergonomic improvements can increase the usability of the system while reducing unnecessary stress on patients and focusing control on effective kinematic therapy and exercise. Overall, the assistive rehabilitation elliptical system described herein can facilitate an effective and comfortable rehabilitation environment for patients.

In embodiments of the disclosure, an assistive rehabilitation elliptical system can be configured, at least in part, as described in U.S. Pat. No. 8,177,688, issued May 15, 2012, and titled, "REHABILITATION AND EXERCISE MACHINE;" U.S. Pat. No. 8,007,405, issued Aug. 30, 2011, and titled, "REHABILITATION AND EXERCISE MACHINE," which claims priority under 35 U.S.C. § 119(e) of U.S. Provisional Application Ser. No. 61/250,718, filed Oct. 12, 2009, and titled "Intelligently Controlled Assistive Rehabilitation Elliptical Machine;" and/or International Application Number PCT/US10/51711, filed Oct. 6, 2011, and titled, "IMPROVED REHABILITATION AND EXERCISE MACHINE," which are herein incorporated by reference in their entireties.

Example Implementations

Figure 1:
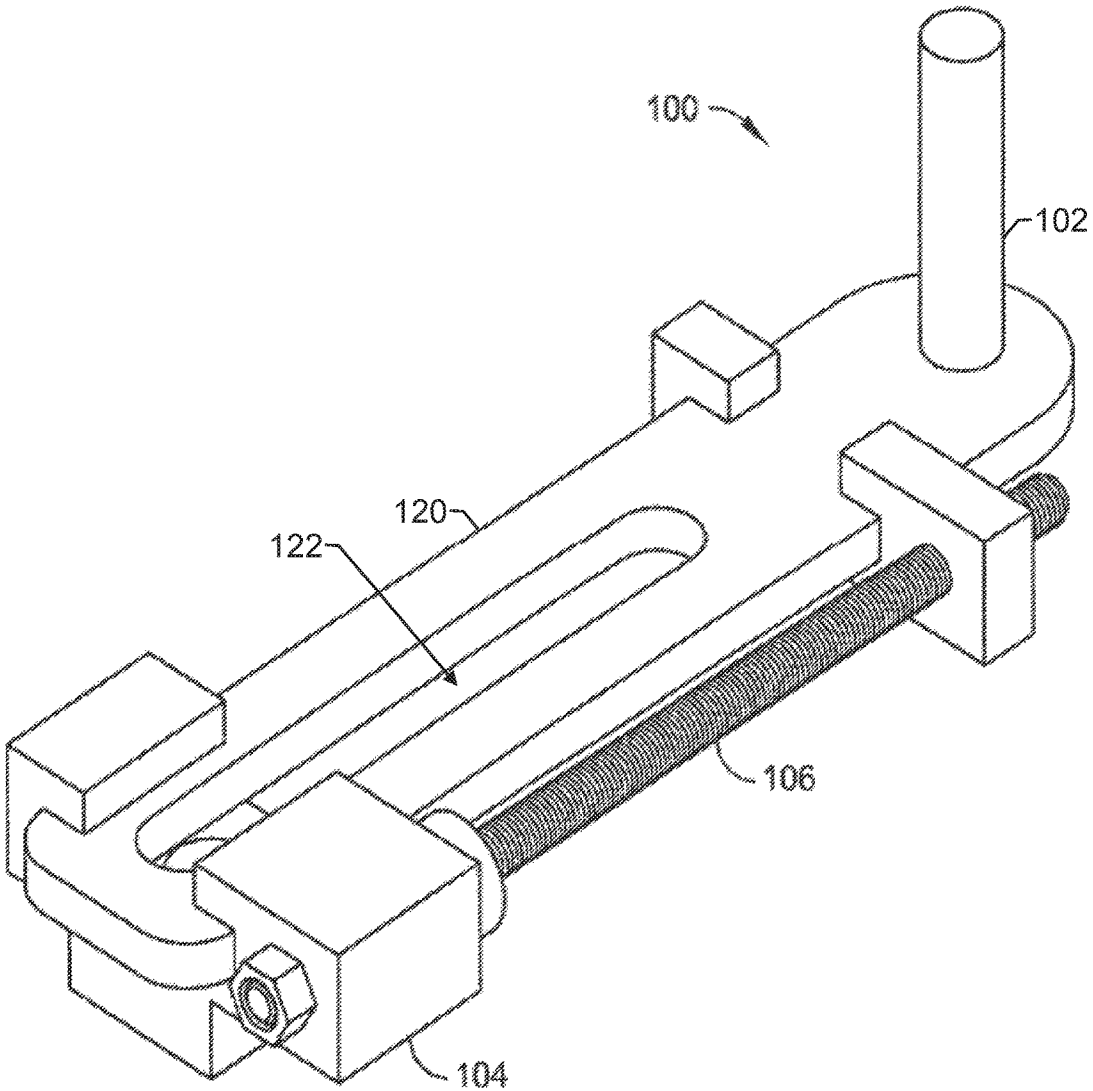
FIG. 1 is a perspective view of a crank assembly for an elliptical machine in accordance with an example embodiment of the present disclosure.
Figure 2:
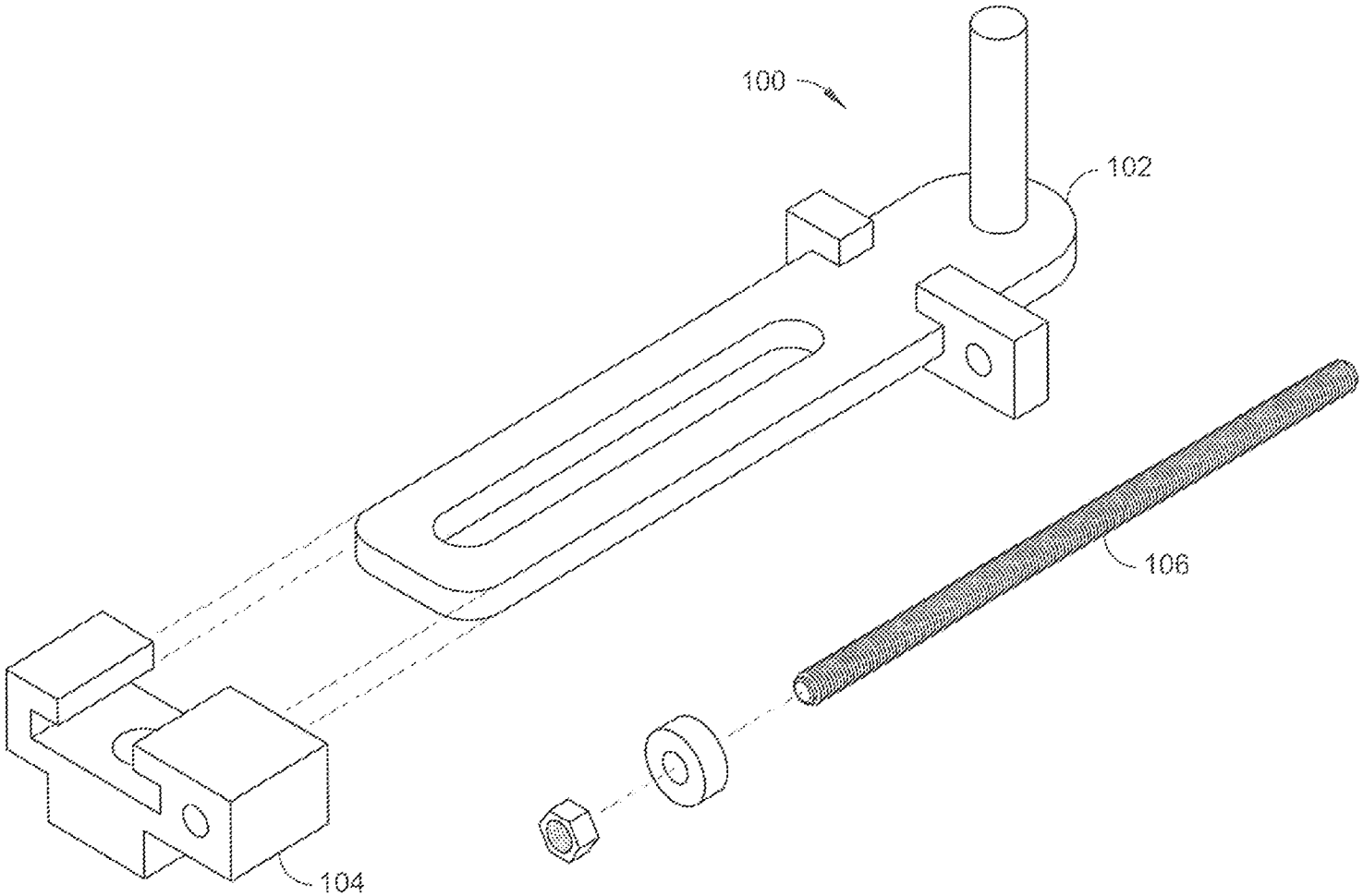
FIG. 2 is an exploded view of the crank assembly illustrated in FIG. 1.
Figure 3:
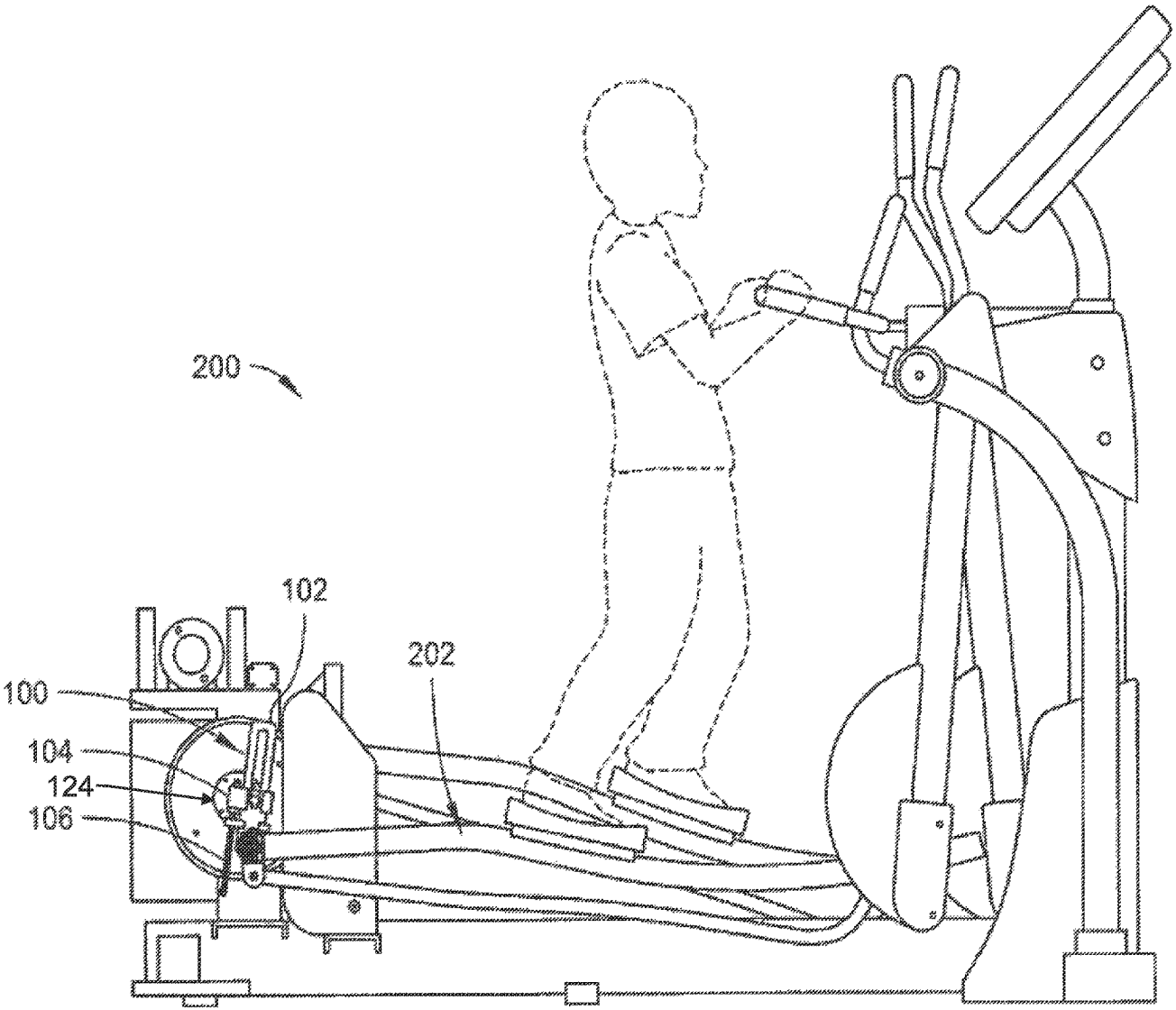
FIG. 3 is a side view illustrating a crank assembly installed in an assistive rehabilitation elliptical system in accordance with an example embodiment of the present disclosure.

Referring now to FIGS. 1 through 6, a crank assembly 100 is described for a system that simulates bipedal gait (e.g., an elliptical system), where the crank assembly 100 enables the system 200 to accommodate varying stride lengths and/or gaits of various users. In some implementations, assistive rehabilitation elliptical systems described herein can also be used to address the rehabilitation needs of younger children. An assistive rehabilitation elliptical system 200 (e.g., as shown in FIG. 3) can include at least one crank assembly 100 for adjusting stride length. It is further noted that the crank assembly 100 may be employed in other settings, e.g., for related exercise/rehabilitation equipment. The assistive rehabilitation elliptical system can operate on the principle that shortening the drive crank 100 can reduce the displacements induced throughout the system 200.

As shown in FIGS. 1 and 2, the crank assembly 100 for the assistive rehabilitation elliptical system 200 can include a drive crank 102, which may have slotted body to allow relative motion of an attached axle connection bracket 104 to travel along the longitudinal body of the slotted body while transmitting torque from the crank. The crank assembly 100 can include an adjustment mechanism (e.g., a screw 106 longitudinally aligned with or parallel to the slot) for adjusting the position of the axle connection bracket 104 along the slot in the crank 102. In some embodiments, the crank assembly further includes a block fixed to the crank for retaining the screw 106, and means for adjusting the screw (e.g., a socket or nut attachment on the end). While a slotted crank link is described herein and shown in the drawings, other couplings for the axle connection bracket 104 can be used as well. For example, in other embodiments, the axle connection bracket 104 can be supported by two screws (e.g., similar to screw 106) parallel to one another without any other body structure in between or with a longitudinal body structure in between for stabilizing the axle connection bracket. By way of another example, the axle connection bracket 104 can be coupled to a telescoping member that extends or retracts to adjust the displacement between the axle connection bracket 104 and the crank 102. A crank link having notches corresponding to discrete bracket positions could be used as well, among other possible adjustable couplings between the crank 102 and the axle connection bracket 104. Additional features to make the overall system easy to use may include an access hole in the housing to adjust the screw (or other adjustment mechanism) and a transparent panel to allow visual access to an indicator for ascertaining the crank-slot displacement.

In some embodiments, the screw 106 (or other adjustment mechanism) can be motorized such that its displacement is known and manual adjustment may be unnecessary. This configuration can use a slip-ring interface to provide power to the motor, since the motor may rotate continuously with the crank. This can be used in conjunction with other stride-length adjustment mechanisms (such as those which operate by changing the length of oscillating links of the mechanism) to greatly extend the range of adjustment, and particularly to make the stride length quite small, suitable for pediatric use. The left and right sides of an elliptical system or similar device can also be independently adjusted to accommodate rehabilitation needs such as unilateral weakness, range of motion mismatch, etc.

The gait motion of children can be very similar to the gait motion of adults. For example, the gait of a child may mature to match characteristics of adult ambulation by the age of about two. In another instance, dimensionless data plotted for children ranging from one (1) year to seven (7) years in age shows a strong correlation between leg length and stride length. In this manner, there can be a maturation of stride length in relation to the age of a child.

As described herein, assistive rehabilitation elliptical systems can produce a gait-like movement trajectory differently from other technologies currently used for gait therapy. In particular, the assistive rehabilitation elliptical systems can use a distal point of control (e.g., a foot on a pedal) to advance a limb through successive cycles. In contrast, robotic devices may focus on manipulating joint motions and forces to produce an acceptable pattern of gait. The delocalized nature of the assistive rehabilitation elliptical systems described herein can accommodate multiple patients merely by adjusting stride length and rate (i.e., cadence).

In some embodiments, assistive rehabilitation elliptical systems can be modified to accommodate the smaller body size of a child by considering normalization factors relating pediatric gait to, for example, adult gait. In some embodiments, one or more gait parameters can be defined in terms of body mass, leg length, cadence, the gravitational constant, and so forth. The motor system of assistive rehabilitation elliptical systems as described herein can automatically adjust to the assistance needs of individuals of differing weights, while the delocalized nature of the machine can mean that performance may be less dependent on leg length than on stride length. Thus, a tight control of stride length and cadence can be used to ensure that modifications allow for successful pediatric use.

Aside from stride length and cadence, pediatric patients may differ from adults in the lateral distance between feet when walking and the maximum foot height during the swing phase of gait, Adjustments for both of these distances can also be accomplished as described herein.

Looking now to FIG. 3, assistive rehabilitation elliptical systems 200 can employ a modified crank-rocker four-bar linkage 202. Both stride length and cadence can be strongly correlated to the crank length and angular velocity on the assistive rehabilitation elliptical system. Maximum foot height can be correlated to the crank length, but it can also be correlated to other parameters. Thus, in some embodiments an assistive rehabilitation elliptical system for pediatric use includes an adjustable crank (e.g., the crank assembly 100 previously described herein).

On some elliptical machines, the crank is a solid metal piece that is rigidly attached to an axle 124 using a set pin and connects to the end of a coupler bar with a revolute joint. In accordance with the present disclosure, assistive rehabilitation elliptical systems can adjust the length of the crank, providing a variable distance between the axle 124 and the revolute joint.

Referring again to FIGS. 1 and 2, a three-piece crank assembly 100 can be used to replace the traditional crank. This crank assembly 100 includes a mobile axle connection bracket 104, a screw 106 and collar, and a crank 102 having slotted crank link 120. The screw 106 is connected to the crank link 120 through a revolute joint and constrained with the collar. The other end of the screw 106 is threaded into a tapped hole on the axle connection bracket 104. The axle connection bracket 104 slides along the crank link 120 freely through a plurality of positions defined by the length of the crank link 120 and/or length of the slot 122, forming a prismatic joint. As the screw 106 turns, it freely rotates in the revolute joint and moves the axle connection bracket 104 along the length of the crank link. With this design, axial load can be transferred from the crank to the axle connection bracket 104 through the screw 106, while shear and bending load can be transmitted directly from the crank to the connection bracket 104.

In some embodiments, a traditional crank assembly can be replaced by the crank assembly 100 described with reference to FIGS. 1 and 2. For example, only the crank assembly may be replaced, with no other part of an elliptical machine needing to be rebuilt, removed, or redesigned to accommodate the new crank assembly (i.e., crank assembly 100). However, as this can create a stringent space restriction, the screw 106 may be located on the side of the axle connection bracket 104 and crank link as shown.

In some embodiments, the distance between the center of the axle and the revolute joint with the coupler bar can be about eight and one-quarter inches (8.25 in.). In some embodiments, the center-to-center distance can be adjusted from about eight and one-quarter inches (8.25 in.) to about three and one-quarter inches (3.25 in.). With the foot pedal set far forward on the coupler, the step length (e.g., maximum horizontal anterior-posterior distance between ipsilateral and contralateral heels) can be varied from about eighteen and one-half inches (18.5 in.) to about seven and one-half inches (7.5 in.) with adjustments to the length of the crank assembly 100 (i.e., the distance between the crank 102 and the axle connection bracket 104). In some embodiments, an additional increase in step length can be accomplished using one or more other adjustment features built into an assistive rehabilitation elliptical system (e.g., using an adjustment of the effective rocker length in a crank-rocker system).

Figure 4:
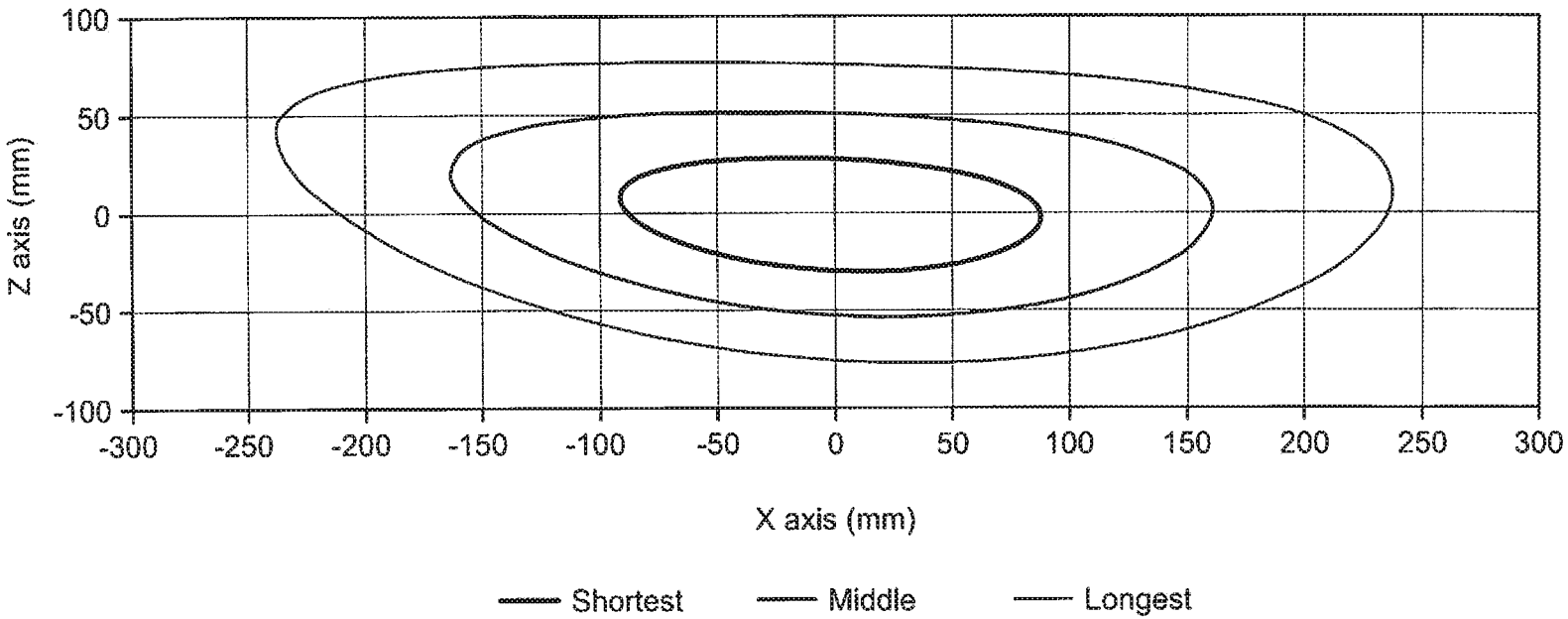
FIG. 4 is a graph illustrating coupler trajectory approximation for three crank assembly lengths for an assistive rehabilitation elliptical system in accordance with example embodiments of the present disclosure.

To assess the impact of crank length on coupler trajectories, three dimensional motion of the pedals on an assistive rehabilitation elliptical system was recorded. Retro-reflective markers were attached to the posterior-lateral aspect of a pedal. A 12-camera motion capture system recorded the pedal trajectory data at one hundred and twenty hertz (120 Hz) over ten (10) continuous cycles at the shortest, middle, and longest crank lengths. Example foot pedal paths of the system are shown in FIG. 4.

As the step length decreased, the height of the foot path also decreased significantly. The trajectory of the foot pedal was very similar between the shortest crank length and the longest crank length. After normalizing the trajectories based on the stride length, there were only minor variances in trajectory. Since normalized child gait data strongly resembles adult gait, similar normalized elliptical paths can be beneficial to pediatric patients. Hence, the crank assembly 100 design is determined to successfully reproduce an adult gait training kinematic profile for pediatric patients.

Figure 5:
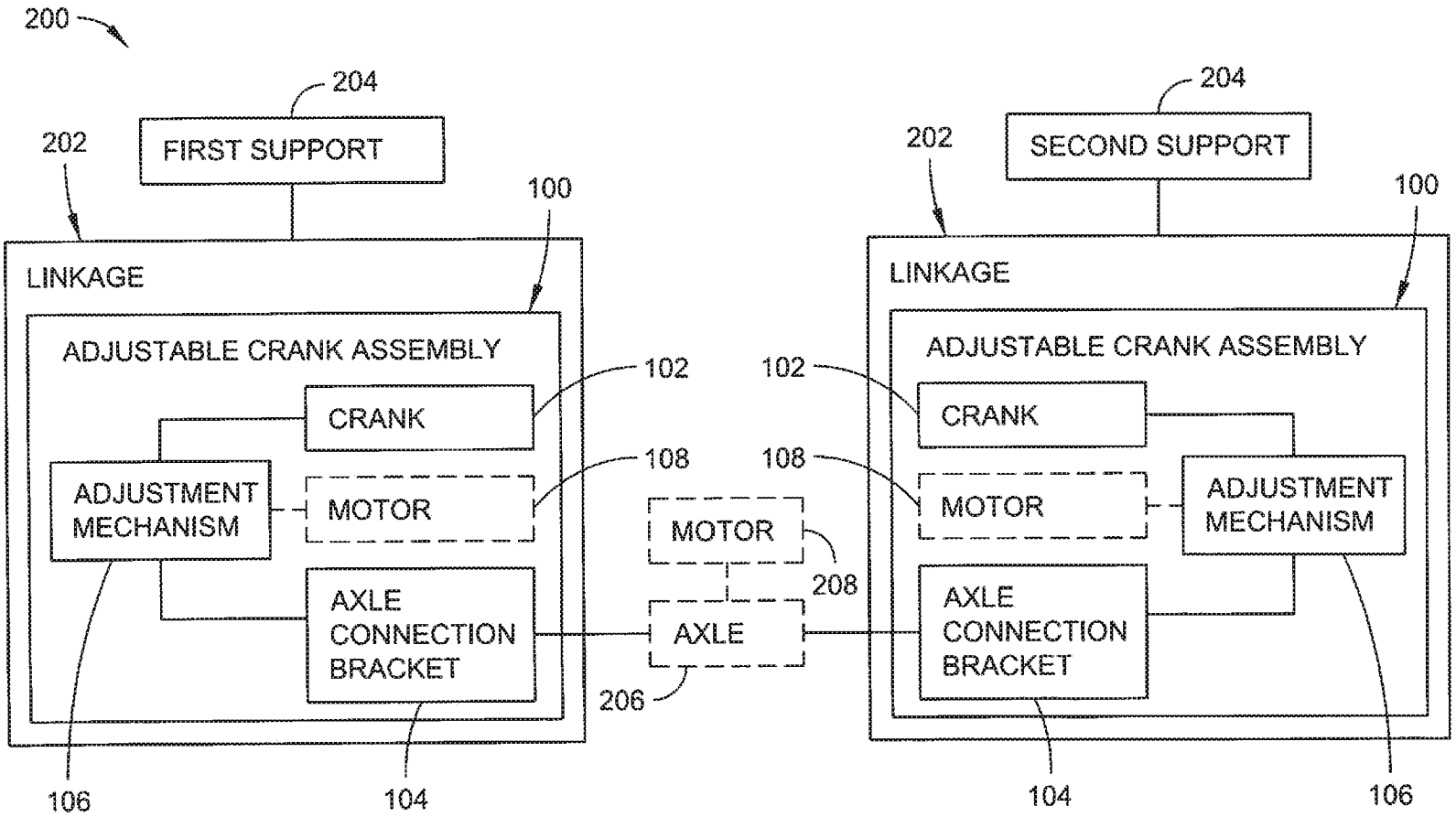
FIG. 5 is a block diagram illustrating various components of an assistive rehabilitation elliptical system in accordance with example embodiments of the present disclosure.

Although elliptical machines are discussed throughout this disclosure, it is noted that the crank assembly 100 can be implemented in any system 200 for simulating bipedal gait. FIG. 5 is a block diagram that illustrates various implementations of the system 200, In embodiments, the system 200 includes first and second support members 204 (e.g., pedal) for supporting a first foot and a second foot, respectively. First and second linkages 202 move the first and second support members through elliptical trajectories, which can be the same for both feet or different based on the crank setting for each foot.

At least one drive assembly (e.g., a shared drive assembly or a respective drive assembly for each linkage 202) can include a crank assembly 100, as described herein, including: a crank 102; and an axle connection bracket 104 that is slidably adjustable with respect to the crank 102, wherein the axle connection bracket 104 is configured to be coupled to an axle 206, and wherein the crank 102 is configured to be coupled to a respective one (or both) of the first and second linkages 202 to move a respective one (or both) of the first and second support members 204 in an elliptical fashion when the axle 206 is rotated. In embodiments, the crank assembly 100 includes a crank link having a longitudinal body, the longitudinal body being connected to the crank 102 at one end and including a longitudinal slot slidably coupled with the axle connection bracket 104, wherein the axle connection bracket is configured to slide through a plurality of positions along the longitudinal body. The crank assembly 100 can include an adjustment mechanism 106, e.g., a screw 106 for adjusting the axle connection bracket 104 with respect to the crank 102. As described herein, the screw 106 can cause the axle connection bracket 104 to slide through one or more positions of the plurality of positions when the screw 106 is turned. In embodiments, a respective actuator 108 (e.g., an electrical motor, a hydraulic actuator, a pneumatic actuator, or a magnetic actuator) is configured to turn the screw 106 to adjust a distance between the axle connection bracket 104 and the crank 102. In some embodiments, the screw 106 is additionally or alternatively configured to be manually turned to adjust a distance between the axle connection bracket 104 and the crank 102.

The adjustment mechanism 106 is illustrated in FIG. 3 as screw-and-slider joint, but could also be a gear and rack, worm/gear or worm/rack, hydraulic or pneumatic coupling, or any other sliding joint that facilitates linear movement of an axle connection bracket 104 of the crank assembly 100 with respect to the crank 102 (effectively changing the crank length). While various examples are provided, the actuation can be achieved in any manner to adjust the effective length of the crank 100 in the elliptical machine 200, reducing the step length and stride height simultaneously.

Figure 6:
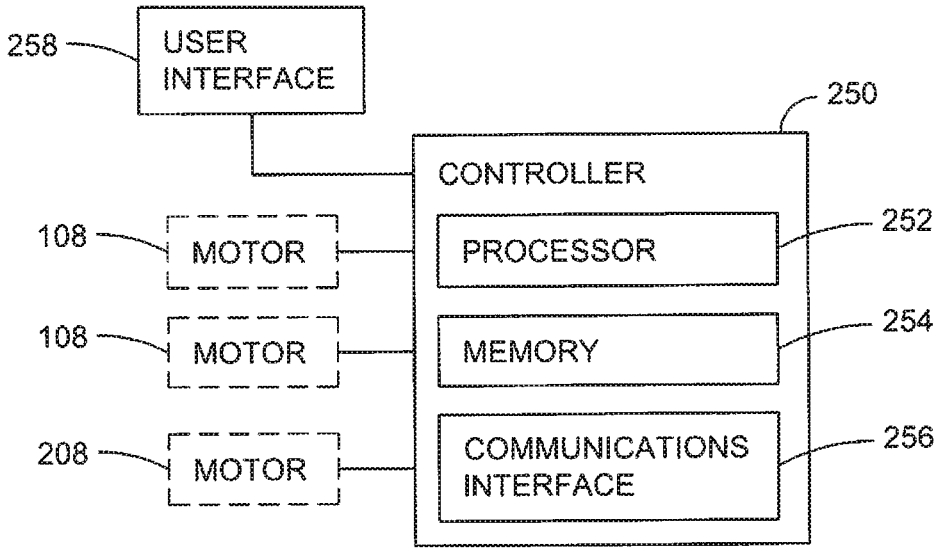
FIG. 6 is a block diagram illustrating a system for controlling gait and/or cadence of an assistive rehabilitation elliptical system in accordance with example embodiments of the present disclosure.

In some embodiments, the system 100 can also include a motor 208 for rotating the axle 206 at a controlled rate. For example, the axle 206 can be rotated according to a programmed or user selected rotational rate or cadence. As shown in FIG. 6, the axle motor 208 can be communicatively coupled to a controller 250 via a communications interface 256 (e.g., wired/wireless connection for transmitting instructions and/or control signals) of the controller 250. The controller 250 can include a processor 252 configured to execute program instructions from a non-transitory memory 254 (e.g., EEPROM, SSD, HDD, SD card, flash memory, etc.). The program instructions cause the controller 250 to accept instructions or provide notifications via a user interface 258 (e.g., display, keypad, touch screen/panel, audio input/output device, etc.) and provide corresponding instructions and/or control signals to the motor 208. For example, the controller 250 can control the rate at which the motor 208 spins the axle 206. The controller 250 can also be communicatively coupled with one or more motors 108 for driving the adjustment mechanism (e.g., screw 106) of the crank assembly 100. The program instructions can cause the controller 250 to accept instructions for adjusting the crank assembly 100 via the user interface 258 and provide corresponding instructions and/or control signals to the motor(s) 108. For example, the controller 250 can cause motor 108 to rotate a respective screw 106 in order to increase/decrease the distance between the axle bracket 104 and the crank 102.

In embodiments of the disclosure, assistive rehabilitation elliptical systems can be designed to have a maximum weight limit. When the body weight support feature is not used, the patient can shift from one foot to the other, supporting full body weight across both pedals throughout each gait cycle. The proximity of the foot pedals to the rocker enables much of the patient's weight to be carried by the rocker, limiting the loading on the crank. Thus, the crank assembly 100 can be designed assuming that the entire weight of the patient is placed on the coupler immediately adjacent to the revolute joint connection with the crank (e.g., in a worst-case loading scenario). For example, if the weight of the coupler bar and foot pedal attachments is approximately twenty pounds (20 lbs.) and the maximum weight limit is approximately two hundred and fifty pounds (250 lbs.), the tested weight transmitted through the modified crank assembly 100 can be about two hundred and seventy pounds (270 lb.).

In some embodiments, the minimum screw size can be determined by the load requirements. During one cycle, the screw can carry all of the weight of the patient and coupler bar in both tension and compression. The axial stress in the screw can be determined as follows:

$$\sigma_a = \frac{F}{A_{eff}} = \frac{4F}{\pi d_r^2}$$

where F represents the applied load, $A_{eff}$ represents the effective cross-sectional area, and $d_r$ represents the minimum screw diameter.

In some embodiments, the most critical loading location on the screw can be the thread contact between the screw and the axle connection bracket. For example, only the first seven engaged threads of a screw may carry weight, and the first engaged thread may carry about thirty-eight percent (38%) of the load, with subsequent threads carrying less. Since the screw contact occurs on the threads, the force occurs on an off-axis incline and lateral and shear forces exist. The lateral and shear forces can be determined as follows:

$$\sigma_x = \frac{6F}{\pi d_r n_t p}$$

-continued $$\tau_{yz} = \frac{16T}{\pi d_r^3}$$

where $n_t$ represents the number of engaged threads, and p represents the screw pitch. T represents the torque required to turn the screw against the weight applied to it, and can be determined as follows:

$$T = \frac{Fd_m}{2}\left(\frac{l + \pi f d_m \sec\alpha}{\pi d_m - fl\sec\alpha}\right) + \frac{Ff_c d_c}{2}$$

where $d_m$ represents the pitch diameter, f represents the friction coefficient between the screw and bracket, l represents the lead of the screw, α represents the thread angle, $f_c$ represents the friction coefficient between the collar and the bracket, and $d_c$ represents the mean collar diameter.

To determine maximum stresses at the joint between the screw and the axle connection bracket, 0.38F can be substituted for the force and $n_t$ can be one (1) thread.

Table 1 (following) shows values for a ⅜-12 ACME threaded rod and collar. Using these values, the following can be determined:

T=21.09 in. lb $\sigma_a$=4,040.18 psi $\sigma_x$=8,061.12 psi $\tau_{yz}$=4,327.53 psi In this configuration, the von Mises stress can be about fourteen thousand, four hundred and eighty-five pounds per square inch (14,485 psi), and the maximum shear stress can be about five thousand, four hundred and eight pounds per square inch (5,408 psi). Using cold-drawn 1018 steel with a minimum tensile strength of forty-five kilo-pounds per square inch (45 kpsi), the factor of safety for a two hundred and seventy pound (270-lb) axial load on a ⅜-12 ACME threaded rod can be about three and one hundred and seven one-thousandths (3.107).

TABLE 1

Screw Variables and Values

| Variable | Value |
|---|---|
| F | 270 lb |
| $d_r$ | 0.2917 in. |
| $d_m$ | 0.3333 in. |
| p | 0.08333 in. |
| l | 0.2708 in. |
| α | 14.5 deg |
| f | 0.08 |
| $f_c$ | 0.08 |
| $d_c$ | 0.5 in. |

Previous research has showed pediatric gait to be very similar to adult gait when normalized to body dimensions. The example assistive rehabilitation elliptical system 200 described herein can be implemented as a therapy device that rehabilitates patients by moving their feet through a gait-like trajectory. By modifying the crank assembly 100 of an example assistive rehabilitation elliptical system, both the stride length and stride height can be reduced simultaneously, and the normalized path of the foot pedal using the crank can be substantially identical to an adult path.

Simulation results showed that maximum stresses in the new design can be acceptable if cold-rolled steel is used. An example assistive rehabilitation elliptical system crank assembly 100 was tested with harsh loading for over a thousand cycles. Following this testing, no damage was noted on the lever arm.

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A system for simulating bipedal gait, comprising:

a first support member for supporting a first foot;

a second support member for supporting a second foot;

a first linkage for moving the first support member through a first elliptical trajectory;

a second linkage for moving the second support member through a second elliptical trajectory; and at least one drive assembly, the at least one drive assembly including:

a crank;

an axle connection bracket that is slidably adjustable with respect to the crank, wherein the axle connection bracket is coupled to an axle, and wherein the crank is configured to be coupled to a respective one of the first and second linkages to move a respective one of the first and second support members when the axle is rotated;

a crank link having a longitudinal body, the longitudinal body being connected to the crank at one end and including a longitudinal slot slidably coupled with the axle connection bracket, wherein the axle connection bracket is configured to slide through a plurality of positions along the longitudinal body; and an adjustment mechanism for adjusting the axle connection bracket with respect to the crank, the adjustment mechanism configured to cause the axle connection bracket to slide through one or more positions of the plurality of positions, wherein the adjustment mechanism comprises a screw located on a side of the crank link outside of the longitudinal slot.

2. The system of claim 1, wherein the at least one drive assembly further includes:

a motor configured to drive the adjustment mechanism to adjust a distance between the axle connection bracket and the crank.

3. The system of claim 2, wherein the motor comprises an electrical motor, a hydraulic actuator, a pneumatic actuator, or a magnetic actuator.

4. The system of claim 1, wherein the adjustment mechanism is configured to be manually driven to adjust a distance between the axle connection bracket and the crank.

5. The system of claim 1, wherein the at least one drive assembly further includes:

a motor for rotating the axle at a controlled rate.

* * * * *